United States Patent [19]

Peebles et al.

[11] Patent Number: 5,012,741

[45] Date of Patent: May 7, 1991

[54] INITIATOR FOR A TRANSMISSION TUBE

[75] Inventors: Richard J. Peebles; Richard J. Michna, both of Winsted; David E. Monat, Torrington; Stephen W. Bartholomew; Craig F. Adams, both of Granby, all of Conn.

[73] Assignee: The Ensign-Bickford Company, Simsbury, Conn.

[21] Appl. No.: 509,490

[22] Filed: Apr. 16, 1990

[51] Int. Cl.[5] ..... C06C 5/00; F42B 3/16; F42B 3/26

[52] U.S. Cl. ..... 102/275.4; 102/275.3; 102/275.7

[58] Field of Search ..... 102/275.3, 275.4, 275.5, 102/275.6, 275.7, 275.11, 275.12, 275.2, 317

[56] References Cited

U.S. PATENT DOCUMENTS

| | | | |
|---|---|---|---|
| 3,878,785 | 4/1975 | Lundborg | 102/275.4 |
| 3,926,119 | 12/1975 | Hurst et al. | 102/317 |
| 4,248,152 | 2/1981 | Yunan | 102/275.4 |
| 4,294,171 | 10/1981 | Ducharme | 102/317 |
| 4,381,711 | 5/1983 | Lawrence | 102/275.11 |
| 4,424,747 | 1/1984 | Yunan | 102/275.2 |
| 4,495,867 | 1/1985 | Mitchell et al. | 102/275.4 |
| 4,714,017 | 12/1987 | Kelly et al. | 102/275.3 |
| 4,722,279 | 2/1988 | Yunan | 102/275.4 |
| 4,815,382 | 3/1989 | Yunan | 102/275.7 |
| 4,821,645 | 4/1989 | Reiss | 102/275.3 |
| 4,911,076 | 3/1990 | Rowe | 102/275.3 |

*Primary Examiner*—David H. Brown
*Attorney, Agent, or Firm*—Hayes & Reinsmith

[57] ABSTRACT

A transmission tube initiator comprises a body having a passageway formed therein for receiving and retaining an initiator charge. A holder holds a side of a transmission tube in close proximity to the charge. The charge provides an initiation signal which penetrates the transmission tube and initiates a reactive substance contained in the transmission tube.

4 Claims, 5 Drawing Sheets

INITIATOR FOR A TRANSMISSION TUBE

TECHNICAL FIELD

This invention relates to initiation of blasting signal transmission devices and more particularly to a device for side initiation of a transmission tube.

BACKGROUND OF THE INVENTION

In detonating blasting charges, transmission tubes are frequently used, being deployed from a central initiating point to send a signal to detonate individual blasting charges.

The transmission tube may be of the type disclosed in U.S. Pat. No. 3,590,739, sold under the trademark "NONEL", and sometimes referred to as "shock tube". As used herein, the term "transmission tube" refers to any detonating or deflagrating signal transmission tube or line including flexible hollow tube, which can carry a detonating signal or deflagrating signal along its interior, which signal may not destroy the tube.

The term "signal" when used in connection with the aforementioned transmission tube is intended to refer to both the detonating shock wave or deflagrating flame front which is transmitted along the (interior of the) tube by combustion of the reactive substances contained therein. A detonator may be activated by first initiating a transmission tube, which transmits a signal by propagating a temperature/pressure reaction down its length and to the detonator. The incoming signal ignites a reactive pyrotechnic composition in the detonator, which in turn ignites an explosive output charge.

There are a number of prior art methods of initiating a signal in a transmission tube using percussion initiated or electrically initiated charges. However, these prior art initiation methods require that the transmission tube environmental seal be broken before initiation to expose the tube reactive substance to the initiating charge. The exposed reactive substance must be aligned with the charge so that when the charge is functioned the reactive substance is ignited thereby initiating signal propagation in the tube.

There are a number of problems associated with these prior art initiation devices. A first problem is that the alignment of certain of the tube reactive substances with the initiation charge may be required to be precise for reliable initiation. Another problem is the fact that the tube reactive substance may be exposed to moisture and other potential environmental contaminants at the location of the proposed point of tube initiation, i.e., at the point of breakage in the tube environment seal, which in turn could cause desensitization of the reactive material and prevent reliable initiation of a signal in the transmission tube. This is of particular concern when tube initiation is desired in rainy weather or wet environments. Yet another problem is that the Department of Transportation regulates the transportation of explosives and explosive initiation devices because of their highly reactive nature, thereby resulting in high transportation costs.

It is therefore a primary object of the invention to provide an improved signal initiation device for reliable non-intrusive initiation of a transmission tube;

it is another obJect of the invention to provide a signal initiation device which is particularly well suited for reliable signal initiation of a transmission tube in a variety of wet environments;

it is a further object of the invention to provide a signal initiation device which may be stored and transported in an inherently safe condition, and therefor, at a reduced cost without restrictive regulations;

it is another object of the invention to provide a signal initiation device which is adaptable to be used with a variety of known firing devices; and it is a further object of the invention to provide a signal initiation device for reliable initiation of a transmission tube while maintaining the integrity of the transmission tube and thereby preventing environmental contamination of the transmission tube reactive material.

Other objects will be in part obvious and in part pointed out in more detail hereinafter.

A better understanding of the objects, advantages, features, properties and relations of the invention will be obtained from the following description and accompanying drawings which set forth certain illustrative embodiments and are indicative of the various ways in which the principles of the invention are employed.

SUMMARY OF THE INVENTION

A transmission tube initiator constructed according to the present invention comprises, in its preferred embodiment, a body having a passageway formed therein for receiving and retaining an initiator charge, a holder is formed at an end of the body for receiving a transmission tube and holding a side of the transmission tube in close proximity to the initiator charge for initiating a signal in the transmission tube through a side of the tube in response to operating the initiaton charge.

In further accord with the invention, a cover may be provided for retaining the transmission tube in the holder during operation of the initiator charge.

The present invention represents a significant advancement over previous devices for initiating a signal in a transmission tube because the transmission tube environmental seal remains intact during signal initiation to maintain the reliability of the transmission tube. Additionally, with the protective cover installed, the device may be safely stored and transported.

DETAILED DESCRIPTION OF PREFERRED EMBODIMENTS

The present invention comprises apparatus for initiation of a signal in a transmission tube without breaking the tube environmental seal, and therefor the present invention improves the reliability of signal initiation and propagation because the tube reactive material is not exposed to environmental contamination.

Figure 1:
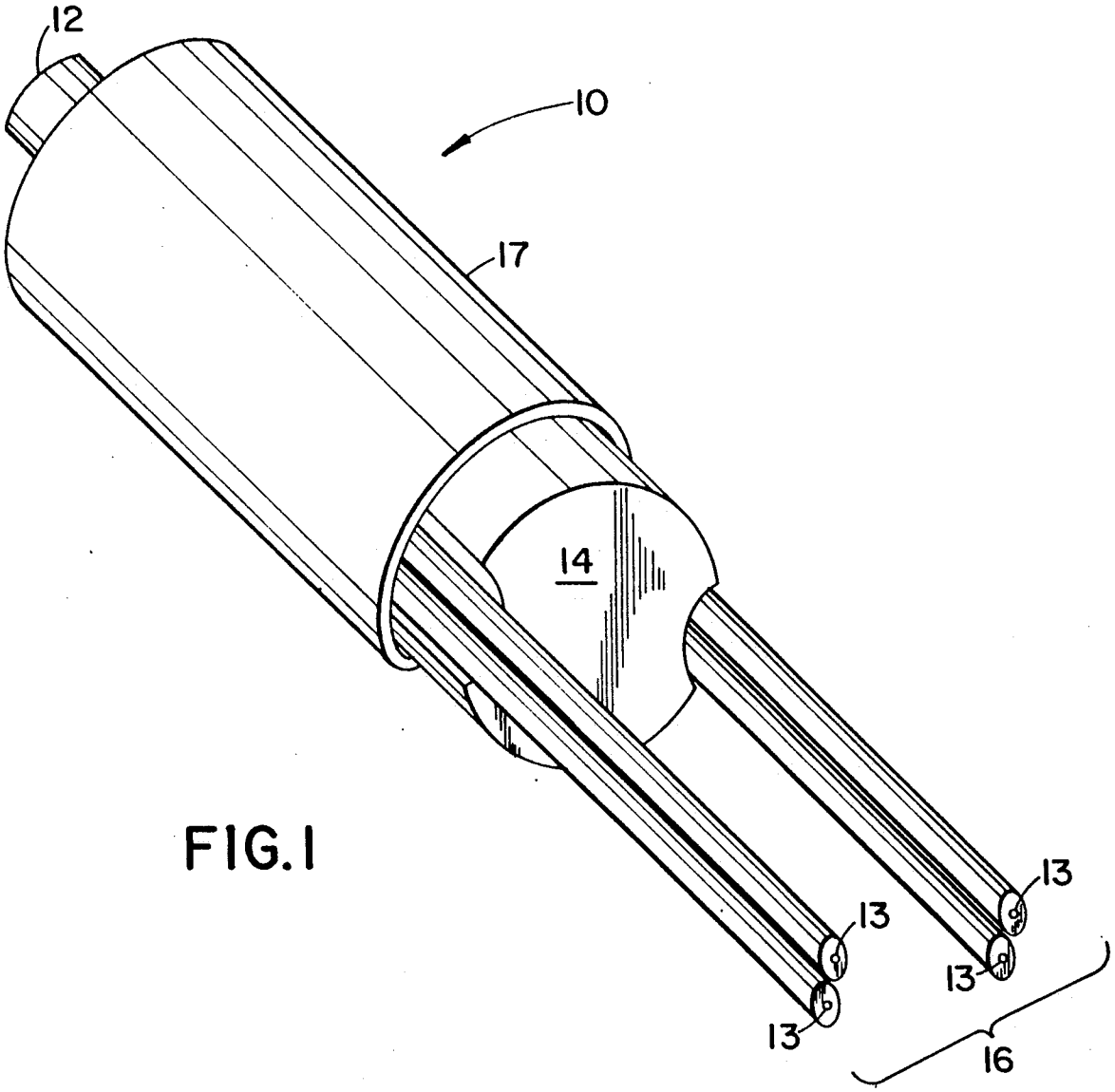
FIG. 1 is a perspective view of the signal initiation device of the present invention installed on a transmission tube, the protective sleeve of the device being closed.
Figure 2:
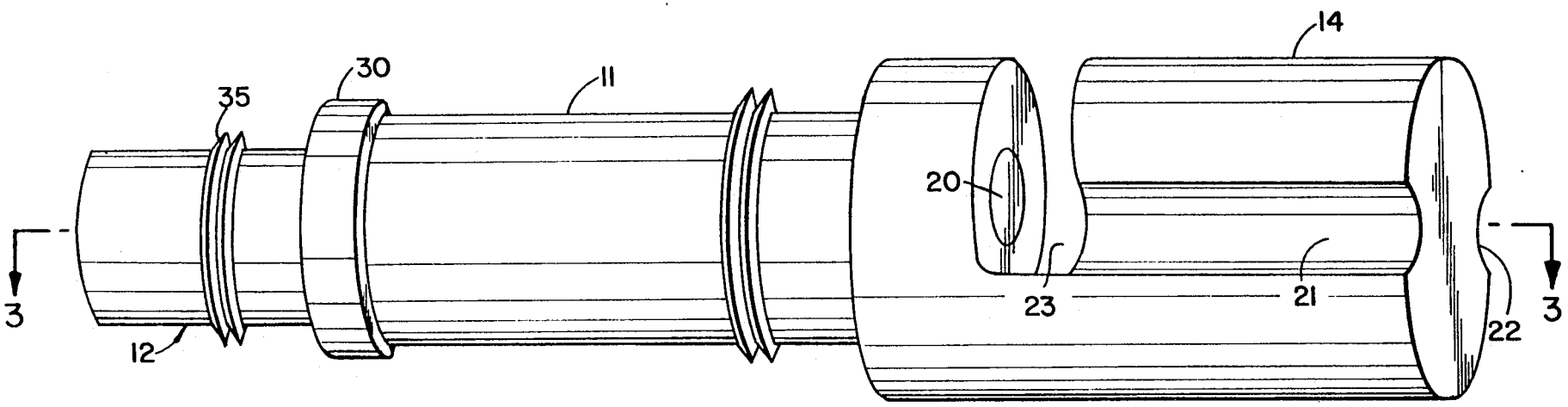
FIG. 2 is a perspective view of the signal initiation device of FIG. 1 with the protective sleeve removed.

Referring in detail to the drawings, a signal initiation device of this invention is generally indicated by numeral 10. As shown in FIGS. 1 and 2, the device 10 comprises a body 11 having a generally cylindrical shape, the body 11 having a cylindrical passageway 20 (FIG. 3) formed therein. A holder 14 is formed to an end of the body 11, the holder also being generally cylindrical in shape, but of a larger diameter than the body 11.

The holder is particularly well suited to hold a transmission tube having reactive material on the internal surface as shown generally at 13 adjacent to an initiator charge contained in the passageway. More particularly, the holder 14 comprises a pair of diametrically opposed, axially extending grooves 21, 22 connected by a slot 23, the combination of the grooves and the slot forming a U-shaped channel. The passageway 20 in the body 11 extends into the holder 14 to the slot 23. The slot 23 is formed perpendicular to the axis of the holder 14, the depth of the slot extending through the grooves 21, 22 and the entire diameter of the passageway 20. In the preferred embodiment, the depth of the grooves 21, 22 is slightly greater than the diameter of a transmission tube, and the width of the grooves is slightly greater than twice the diameter of a transmission tube so that a double thickness of transmission tube will fit snugly in the grooves and slot.

Figure 3:
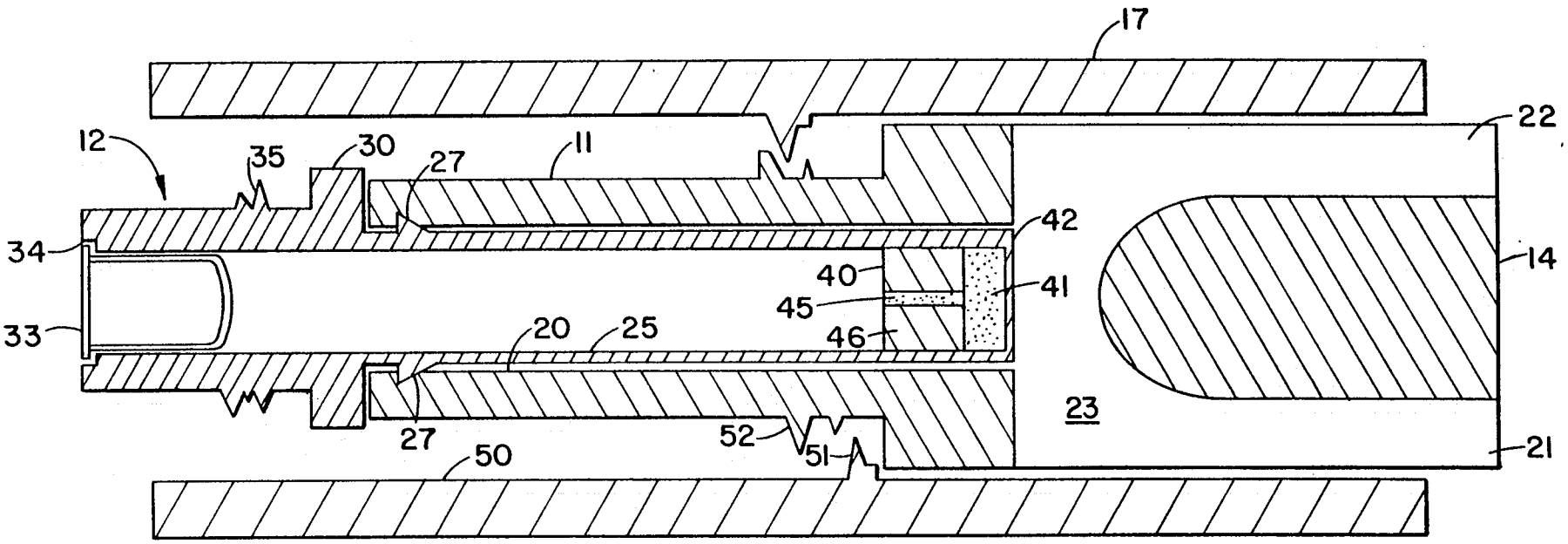
FIG. 3 is a longitudinal cross sectional view of the signal initiation device taken along line 3—3 of FIG. 2.
Figure 4:
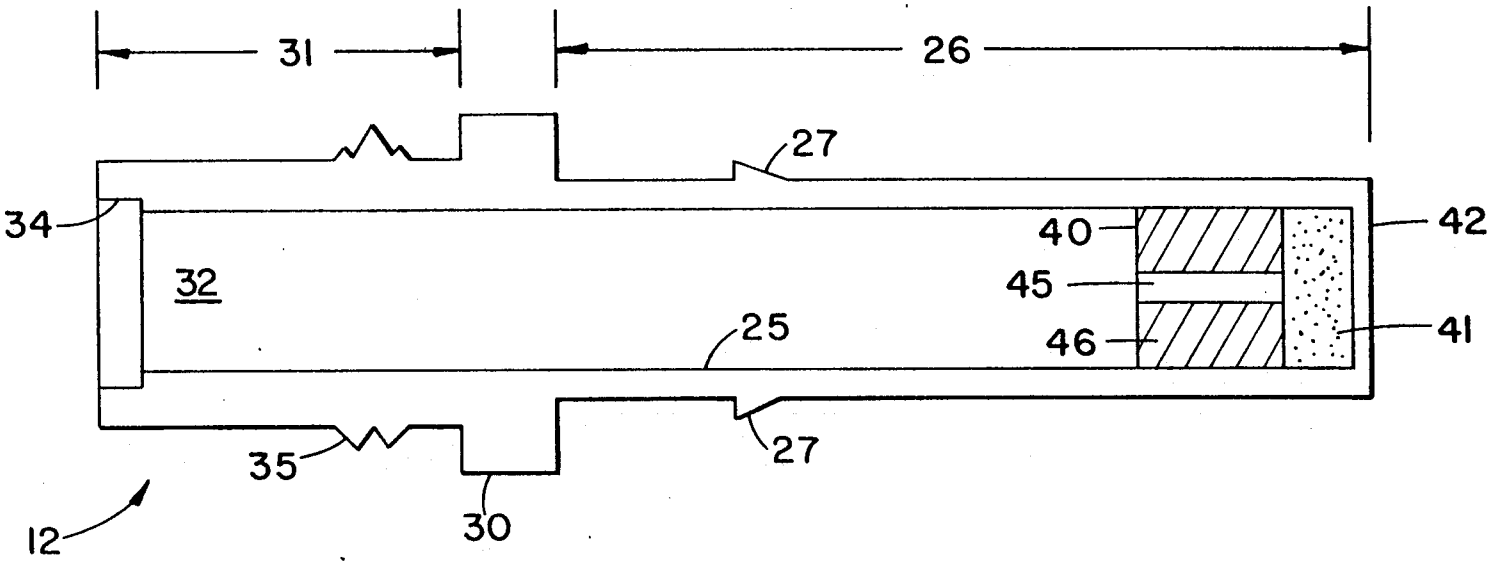
FIG. 4 is a longitudinal cross sectional view of an ignition housing (adapter) of the signal initiation device of FIG. 1.

Refering to FIGS. 3 and 4, an adapter 12 is provided, preferably in a generally cylindrical shape, having a cylindrical hollow core 25. The adapter 12 should possess sufficient strength to resist internal detonating and deflagrating forces during combustion of reactive pyrotechnic transmission and explosive compositions contained therein. The preferred material is aluminum tubing.

The adapter 12 preferably has an outside diameter slightly less than the diameter of the passageway 20 so that the adapter may be received in the passageway. The length 26 of the adapter 20 is selected so that it extends through the length of the passageway 20, an end 42 of the adapter being adjacent to the slot 23. The adapter 20 is preferably provided with a protrusion 27 about its circumference and formed passageway 20. The adapter 12 may additionally be provided with a cylindrical collar 30 of larger diameter than the passageway 20 and positioned near an adapter input end 31. The input end 31 is provided with an opening 32 preferably configured to receive a percussion initiated primer charge 33, such as a Remington 22 caliber shell. A recessed supporting shelf 34 may be formed around the circumference of the opening 32 for supporting the primer charge 33 so that the charge is flush with the end of the adapter when fully inserted, as shown in FIG. 3.

The input end 31 may also be provided with threads 35 around the outside diameter of the adapter between the opening 32 and the collar 30 for secure engagement with a known firing device (not shown) for percussion initiation of the primer charge, e.g., a MK31, MOD O signal projector, an FBI dual initiator system, a Qual-A-Tech Dual Initiator System, or a MK 142 firing device.

The adapter 12 further comprises a delay column 40, an explosive initiator charge 41, and a blow-out end seal cap 42 received in the adapter opposite the opening 32 and adjacent to the slot 23. The delay column 40 contains a shaped reactive composition 15 packed inside a metal tube 46, e.g., lead. The column is placed directly adjacent to, and abutting the initiator charge 41 to receive and transmit a firing signal from the primer charge 33 to the initiator charge 41.

The blow out end seal cap 42 is formed to the end of the adapter adjacent to the slot 23, and is comprised of a section of reduced thickness adapter material. The explosive initiator charge 41 is positioned between the delay column 40 and the end cap 42, and converts the firing signal into an initiating signal of sufficient strength to rupture and blow through the end cap 42 and pierce the transmission tube 16, thereby initiating a signal in the tube. The initiator charge 41 should have sufficient strength to rupture only the end cap 42 and not fracture the sides of the adapter. The initiator charge 41 is preferably made of a primary explosive, such as lead azide, to ensure signal initiation of a transmission tube 16 through the end cap 42.

A protective sleeve 17 of the invention allows an operator easy access to the holder 14 for inserting a transmission tube to be initiated, while also providing a protective containment cover for safe transportion of the device and protection of an operator during field use. More particularly, as shown in FIGS. 1 and 3, the sleeve 17 is cylindrical in shape, having a hollow core 50. The diameter of the core 50 is slightly larger than the outside diameter of the holder 14. The sleeve 17 may be further provided with internal threads 51 for engagement with, and disengagement from, locking threads 52 formed on the body 11. As shown in FIG. 3, when in a closed position the sleeve 17 covers the holder 14, thereby retaining transmission tubes in the holder 14, and the sleeve threads 51 are engaged with the locking threads 52. To access the holder 14, the sleeve threads 51 and locking threads 52 are disengaged by rotating the sleeve, and the sleeve 17 is slid back over the length of the body 11 until the sleeve threads 51 contact the adapter collar 30 in the fully open position.

The body, holder, and sleeve should be made of a strong and lightweight material capable of withstanding the internal explosive force of the initiator charge, and also capable of withstanding external forces which may be applied in field use. The preferred material is polycarbonate.

The invention may be used with two adjacent strands of transmission tube received in the grooves and slot for simultaneous initiation of the tubes, as shown in FIG. 1, or a single strand of transmission tube looped through the grooves and slot. After a transmission tube 16 is received in the holder, the sleeve 17 is slid over the holder 14, and the sleeve threads 51 and locking threads 52 are engaged by twisting the sleeve in a clockwise direction. The adapter threads 35 may then be engaged with the firing portion of one of the aforementioned firing devices. When the operator desires to initiate signal propagation in the transmission tube, the primer charge 33 is operated. The high temperature/pressure primer signal ignites the delay column composition 45, which in turn ignites the initiator charge 41. The initiator charge rapidly detonates, producing a sufficiently high temperature/pressure signal to rupture the end seal cap 42 and pierce the transmission tube, igniting the reactive composition of the transmission tube, and thereby initiating signal propagation in the tube. Any fragments and combustion material are contained by the sleeve 17.

Figure 5:
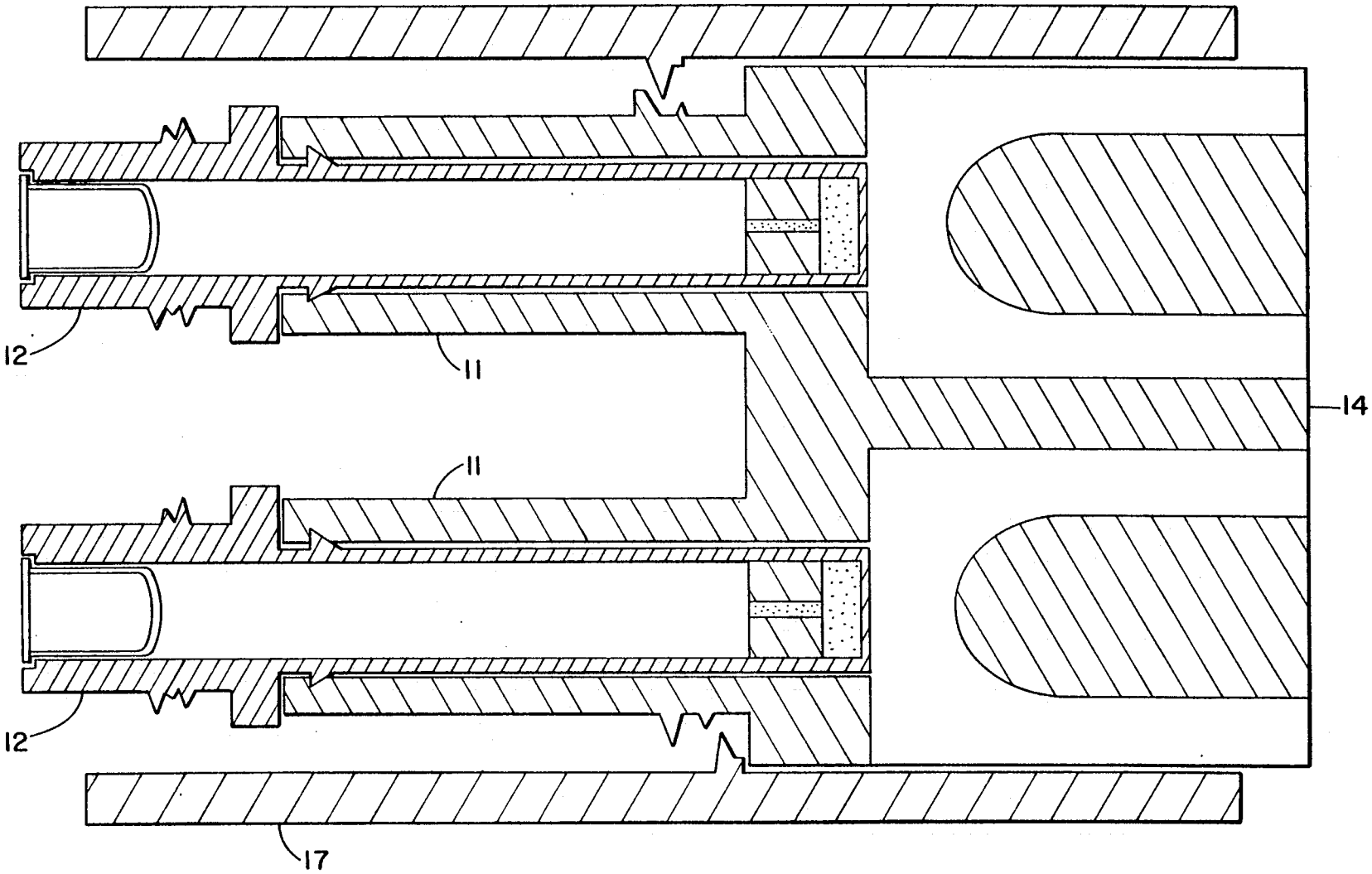
FIG. 5 is a longitudinal cross sectional view of an alternative embodiment of the signal initiation device of FIG. 1.

FIG. 5 illustrates an alternative embodiment oF the invention wherein two adapters are provided to initiate two sets of transmission tubes (not shown) within a single sleeve 17.

Although the signal initiation device is illustrated as being used with a percussion initiated primer charge, it would work equally as well with an electrically initiated primer charge such as an electric match or other electric firing device. In addition, although the signal initiation device is described as preferably being manufactured with a delay column, it is expected that the advantages of the present invention would be realized without the use of the delay column.

Although the invention has been illustrated and described with respect to exemplary embodiments thereof, it should be understood by those skilled in the art that the foregoing and various other changes, omissions and additions may be made therein and thereto, without departing from the spirit and scope of the invention.

I claim:

1. Apparatus for use with a hand-held firing device to initiate a signal through the side of a transmission tube, intermediate sealed ends of the tube, the tube having a reactive substance therein, comprising:

means for connecting the apparatus to the firing device;

initiation means for providing an initiation signal in response to the selective activation of said initiation means by said firing device, said initiation signal being of a character sufficient to convey a signal through the side of the tube to initiate the reactive substance;

a body having a passageway formed therein, said passageway being configured for receiving and retaining said initiation means, said body retaining said initiation signal upon activation of said initiation means;

a holder having a channel formed therein for receiving the transmission tube, said holder holding a side of the transmission tube in close proximity to said initiation means for initiating a signal in the tube in response to said selective activation of said initiation means; and a protective containment cover for retaining the transmission tube in said holder, said cover being capable of withstanding the internal force of said initiation signal.

2. Apparatus according to claim 1 wherein said holder and said cover are cylindrical in shape, said cover being slidable over said holder between a closed position and an open position.

3. Apparatus according to claim 2 further comprising locking means on said holder and said cover for locking said cover on said holder.

4. Apparatus according to claim 3 wherein said locking means comprising threads on an extension surface of said holder and threads on an interior surface of said cover.

* * * * *

UNITED STATES PATENT AND TRADEMARK OFFICE

CERTIFICATE OF CORRECTION

PATENT NO. : 5,012,741

DATED : May 7, 1991

INVENTOR(S) : Richard J. Peebles et al

It is certified that error appears in the above—identified patent and that said Letters Patent is hereby corrected as shown below:

Column 3, line 43, after "about its circumference and formed" insert --intermediate its length for holding the adapter securely in the--.

Column 3, line 66 , "composition 15" should be --composition 45--.

Column 4, line 65, "oF" should be --of--.

Signed and Sealed this

Twenty-eighth Day of April, 1992

*Attest:*

HARRY F. MANBECK, JR.

*Attesting Officer*

*Commissioner of Patents and Trademarks*